United States Patent [19]

Simensen et al.

[11] Patent Number: 4,790,172

[45] Date of Patent: Dec. 13, 1988

[54] METHOD FOR PROVIDING A TUBULAR NODE IN A FRAMEWORK TRUSS STRUCTURE SUCH AS OFFSHORE PLATFORMS FOR OIL DRILLING AND PRODUCTION

[75] Inventors: Per A. Simensen, Løvenstad; Gunnar H. Eide, Sandvika, both of Norway

[73] Assignee: Saga Petroleum a.s., Høvik, Norway

[21] Appl. No.: 878,981

[22] PCT Filed: Sep. 18, 1985

[86] PCT No.: PCT/NO85/00056

§ 371 Date: May 20, 1986

§ 102(e) Date: May 20, 1986

[87] PCT Pub. No.: WO86/01752

PCT Pub. Date: Mar. 27, 1986

[30] Foreign Application Priority Data

Sep. 21, 1984 [NO] Norway ..... 843792

[51] Int. Cl.[4] ..... B21K 1/14

[52] U.S. Cl. ..... 72/368; 72/377

[58] Field of Search ..... 29/157 R, 157 T; 403/205, 403; 285/150, 155, 156; 405/204; 72/368, 377

[56] References Cited

U.S. PATENT DOCUMENTS

| | | | |
|---|---|---|---|
| 2,067,945 | 1/1937 | Peters | 29/157.5 |
| 2,736,949 | 3/1956 | Kraemer | 285/155 |
| 3,535,909 | 10/1970 | Latham | 29/157 T |
| 4,083,219 | 4/1978 | Combes et al. | 72/352 |
| 4,092,077 | 5/1978 | George | 403/178 |
| 4,100,753 | 7/1978 | Mott et al. | 61/86 |
| 4,370,790 | 2/1983 | Rodaway | 29/157 T |
| 4,450,613 | 5/1984 | Ryan et al. | 29/157 T |
| 4,489,659 | 12/1984 | Kamohara et al. | 403/205 |

FOREIGN PATENT DOCUMENTS

| | | |
|---|---|---|
| 1075049 | 4/1980 | Canada . |
| 0004240 | 9/1979 | European Pat. Off. . |
| 120314 | 7/1898 | Fed. Rep. of Germany . |
| 700604 | 11/1940 | Fed. Rep. of Germany . |
| 1097393 | 5/1953 | Fed. Rep. of Germany . |
| 1034125 | 1/1955 | Fed. Rep. of Germany . |
| 940703 | 3/1956 | Fed. Rep. of Germany . |
| 1072581 | 1/1960 | Fed. Rep. of Germany . |
| 2123925 | 5/1971 | Fed. Rep. of Germany . |
| 2747166 | 10/1977 | Fed. Rep. of Germany . |
| 738000 | 10/1932 | France . |
| 1062963 | 12/1943 | France . |
| 931975 | 11/1947 | France . |
| 1217174 | 12/1959 | France . |
| 2369028 | 10/1977 | France . |
| 53-56156 | 5/1978 | Japan . |
| 140949 | 9/1979 | Norway . |
| 142454 | 5/1980 | Norway . |
| 145731 | 2/1982 | Norway . |
| 700855 | 12/1953 | United Kingdom . |
| 1550069 | 8/1979 | United Kingdom . |
| WO82/02569 | 8/1982 | World Int. Prop. O. . |

*Primary Examiner*—Lowell A. Larson

*Attorney, Agent, or Firm*—Fleit, Jacobson, Cohn & Price

[57] ABSTRACT

A method for providing a tubular node in framework truss structures, such as offshore platforms for oil drilling and production activities of the type consisting of interconnected legs and braces of steel tube elements. For formation of the transition between leg and brace in the node is utilized a blank of rolled plate steel, which is given the desired curved shape corresponding to the curvature of the leg. The blank is pressed or extruded in a suitable press tool formed with an outwardly extending brace stub at the desired angle, which brace stub is designed for welding to a complementary brace tubing in the framework. Thereafter, the blank with the brace stub is welded into the leg proper and constitutes a wall segment of the leg in the node.

13 Claims, 4 Drawing Sheets

Figure 1A:
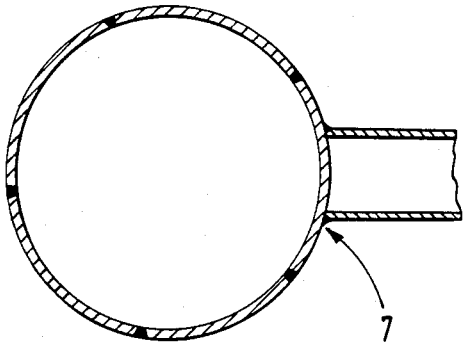
Fig.1a (PRIOR ART)

METHOD FOR PROVIDING A TUBULAR NODE IN A FRAMEWORK TRUSS STRUCTURE SUCH AS OFFSHORE PLATFORMS FOR OIL DRILLING AND PRODUCTION

The present invention relates to a new solution for construction of tubular nodes in framework truss structures of the kind consisting of interconnected legs and braces made of steel tubes. Such structures are being used to large extent in stationary and mobile offshore platforms for oil drilling and production activities.

In conventional construction approaches for such structure the braces are directly welded to the legs to form the tubular nodes, i.e. the joints between the legs and bracings. Such nodes may consist of a single brace and leg or of multiple bracings joining the leg in one or multi planes. Although direct welding of the braces to the leg is a simple solution from point of view construction, it is fully realized that it causes many serious problems and detriments. Firstly, it requires careful and costly preparation and adaption of the surfaces to be connected by welding, particularly if the braces are joined in an oblique angle. The welding is also complicated by the fact that the wall thickness of the connected tubes is, as a rule, different. Further, the subsequent control of the weld quality, for instance by means of ultra sound or X-rays of such welds is often very complicated because of limited accessibility. Experience has shown that because of this, one often can not ensure the quality of the welding work. These problems are amplified, in the case of angular and multibrace nodal joints.

In order to increase the stiffness and strength of the nodes it is often necessary to increase locally the wall thickness of the leg at the node or also the wall thickness of the braces. Such measures contribute however further to the welding problems and lead also to increased weights and higher costs of the platform.

Also from structural-strength point of view, the conventional solution is far from ideal. The junctions brace/legs represent geometrical discontinuities which give rise to very high material stress peaks and stress concentrations at these locations. The fact that in traditional solutions the connecting weld is placed at these very locations of extremely high stress concentration will necessarily result in a very serious further detriment to the strength and safety of the node. This because the environment wave loads are dynamic in theis nature, and the latter together with the high stress concentrations at the weld toes of conventional nodes give rise to a severe fatigue strength problem which may result in development of early cracks at the weld toes and subsequently failure of the connection arising from these locations.

Serious failures in platform rig structures during the past years, especially with those used in severe environments such as the North Sea, have proven that in the design of such offshore platforms both the static and the fatigue strength of the structure must be thoroughly considered and its adequacy must be satisfactory verified. This implies first of all that the node and the members between the nodes must possess sufficient strength. This implies that the structures should show sufficiently low probability of failure with respect to the following failure modes:

1. Static strength of the node, i.e. a stability to sustain extreme loads without undue permanent deformation, collapse, or even crunching shear rupture.

2. Buckling/yielding of the members between the nodes.

3. Fatigue failure due to crack initiation and crack propagation.

In order to create a stronger and more durable joint between legs and bracings in frame work structures of this kind it has been proposed to avoid the welding at the junction of the tubulars where very high stress concentration occur and instead to form brace stubs in one-piece node which is prefacricated and is welded in place as section of the structure directly to the legs and bracings. Such solutions have, however, hitherto not been adapted by the platform rig industry and has as far as is known not been tried out in practice. The main objection has been that in connection with casting or moulding there will always be present an inevitable risk for moulding defect such as internal bladders and cracks, and such possible defects cannot be disclosed with absolute 100% warranty in connection with known control equipment. Furthermore will the casting of cast work of this size fall undue expensive and time consuming, and the casting must usually take place in a factory located at a remote distance from the building site of the rig.

A number of similar solutions in order to provide improved nodes for framework for platform rig constructions have been proposed. As examples of other solutions can be referred to Norwegian patent specifications No. 140 949, 142 454 and No. 145 731. These patents show different embodiments for nodes, made in relatively small dimensions and as solid pieces of goods made of die forged or cast steel, in some cases reinforced with welded cross pieces, etc. The node bodies are prefabricated with the desired stubs to be welded to the bracing in the framework structure. It is further as a supplement to these solutions proposed to use special conical transition pieces between the node and the pipe bracing having larger dimensions such that the nodes can be made with the prescribed small overall dimensions. Small dimensions in the node are obviously the ideal from a static design point of view and they are otherwise assumed to be a possible solution, from a constructional point of view, partly because one can utilize so-called isotropic material, i.e. material which has the same strength properties in all directions (in contrary to rolled plate goods which normally are weaker in transverse direction), partly because small dimensions result in small moments of inertia and thereby reduced bending stresses.

In spite of their apparent good merits—both in regard design and in regard static forces—such solid node solutions have, however, not been accepted in connection with larger platform rig constructions. One reason for this situation may be that the nodes fall expensive and time consuming to make, frequently at a production site which is remotely located from the building site of the rig. An important practical drawback with such nodes is that the legs cannot be utilized as a downlead for piles or passage for drilling equipment, production equipment etc.

A further proposal for node solution consists in that the leg is encircled by a collar-like ring which is provided with one or more transition pieces designed to be joined to the bracing in the frame work. In a preferred embodiment for such solution is utilized a special collar with transition pieces to each separate bracing in the nodes. A such collar solution can in many ways seem more attractive than the precedingly described solid mass node solution, but the solution gives on background of the large or extended dimensions of the node itself a source for large stress concentrations and also considerable adaptation problems, particularly in the transition pieces on the collar.

In general one can conclude that in connection with large frame work structures for purposes such as offshore platform rig constructions, the nodes constitute the weakest link in the structure, both in regard the total strength of the rig and in regard the lifetime of the rig, due to the prevailing risks for fatigue failures in the nodes.

The main object of the present invention has been to develop a new improved node solution for large frame work structures made of steel tubing.

A special object of the invention is to provide a method for making nodes adapted to be joined with bracings extending both at a right angle relative to the leg and at tilted or oblique angles, such as 45° relative to the leg in direction upwards or downwards.

The method in accordance with the invention has the aim to provide a tubular node in frame work truss structures, such as offshore drilling platforms and the like designed for severe wave conditions, and consisting of legs and braces of steel tube elements, and the invention is characterized in that for the formation of the transition between the leg and the bracing is utilized a transition member made from a plate blank of rolled steel, which plate blank is given the desired curved shape corresponding to the curvature of the leg in that said blank, and by means of pressing or extrusion in a suitable press tool, is being formed with one at desired angle extending brace stub designed for welding to a complementary brace tubing in the framework, whereafter the plate blank stub is welded into the leg proper and thereby constituting a wall segment thereof at the node.

In dependence upon the size and other criteria of the node structure, the pipe stub formed can present a mouth opening in a plane positioned normal to the stub axis or at an angle thereto, for instance in a plane being parallel with the leg axis.

The forming of the plate element including the pipe stub can take place in one separate press and/or extrusion operation or in several operations with or without repeated, intermediate heat treatment in order to recover the ductility of the material.

The special tool to be used to make the stub in the plate element can be cylindric or slightly conical, preferably with a rounded off or substantially spherical front end. The matrix is provided with a complementary opening provided with a suitably rounded off transition zone between the inside plane surface and the inside surface proper of the stub to be made.

A special advantage with the method is that trials have provided that it can be used for the making of oblique stubs in the plate element. This is provided by using a tool with a piston or the like which is directed in the desired angle relative to the goods in the leg, and the matrix is likewise provided with an oblique opening given the correct, oval, rounded off opening zone.

The plate section including the stub can constitute a complete integral ring section of the leg or only a wall segment of the leg. The latter alternative will be the only alternative in connection with legs having large diameter. Such large legs will along the circumference consist of for instance five steel plate sections welded together as segments in the annular structure. The plate section or segment which shall serve as a blank for the stub may have the same thickness as the other sections in the leg in the node part of the leg, but may alternatively have a larger thickness, either only in the plate section for the stub, or all the plate sections in this circumferential or annular section of the leg may have an increased thickness.

Through the solution in accordance with the invention is provided an improved node design implying a number of other advantages in comparison with known technique, particularly versus the conventional solution with bracing welded directly onto the leg structure. Thus, one avoids sharp angles between the two parts which shall be joined together, which otherwise inevitably lead to large stress concentrations. The goods in the stub is given a uniformly reduced thickness from the thickness in the adjacent leg section to the thickness in the complementary bracing pipe which shall be welded to the mouth opening of the stub. One avoids welding joints just in these areas where the stress concentrations will be most critical, namely the angular transition zone between the leg and the bracing. By extruding or pressing a stub directly in or from the leg material, one will obtain a stub with goods which is somewhat anisotropic, i.e. a material which will have greater strength in the longitudinal direction of the stub than in transverse direction. It has been shown that this is a great advantage on background of the different forms for stresses and strains which will be prevailing in the stub and in the node. The node must be designed with reference to static strength i.e. its ability to sustain extreme brace loads without undue permanent deformation, collaps, and shear rupture. This must be checked against tensile loads as well as compressive forces. The latter, in the case of unstiffened nodes, are as a rule more critical due to ovalization and collapse mechanism of failures. Of other failure modes shall be mentioned risk for buckling/yielding of the various members in the node, and finally fatigue failure due to crack initiation and crack propagation.

However, calculations, practical experience and trials have shown that the most critical failure mode is failures due to fatigue especially in connection with platform rig structures used in offshore environments with severe wave conditions, such as in the North-Sea, practical trials have proven that the invention provides a solution which is especially adapted to overcome the last mentioned problems.

In addition to what is stated before a further reason for the excellent results obtained with the invention can briefly be said to find its origin in that the critical compressive and tensile brace forces are uniformly transferred and distributed to a comparatively large area of the leg, and one avoids simultaneously abrupt changes in the goods and obtains instead an even curved or arched transition fillet between the brace stub and the leg.

Furthermore, on background of the curved transitions between the stub and the goods in the leg, one will obtain access for positioning equipment for ultra sound and x-ray control of the entire transition zone, simultaneously as the need for control will be reduced in the transition zone. Furthermore, necessary control of the stub including the plate element including the stub can be made on the production site for the same, making it superfluous to move such equipment to the production site for the rig, and finally one obtains access to the joint from both sides, something which has not hitherto been possible in connection with welded bracing where the leg surface will close off the joint.

The advantages which therefore are obtained through the invention compared with known types of nodes may be summed up as follows:

1. The nodes will sustain higher fatigue loads.
2. The nodes will attain a much longer operation lifetime.
3. One avoids geometrically complex and costly tubular joints welding works.
4. The need for operational inspections of the nodes will be reduced.
5. Because of their great fatigue strength the nodes in accordance with the invention increase the possibility to design slender and higher rig structures for deeper water without making it necessary to use design criterias other than for static loads (dimensioning for the 100 year wave).

Figure 1B:
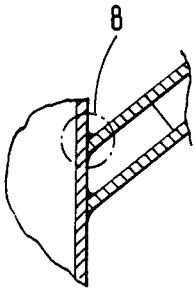
Fig.1b (PRIOR ART)

The invention also involves a number of other important features and advantages which will appear from the following specification, wherein the invention shall be described with reference to the accompanying schematic drawings which illustrate some embodiments of the invention, and wherein:

FIGS. 1*a* and 1*b* show sections taken along horizontal and vertical sections, respectively, the latter in a large scale, of a node in a conventional truss or frame structure designed for an offshore platform rig and consisting of tube shaped legs and braces.

Figure 2:
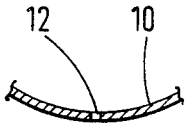

FIG. 2 is showing a plate or segment of a plate blank for a leg which shall be provided with a brace stub, the blank as shown furnished with a "starting bore".

Figure 3A:
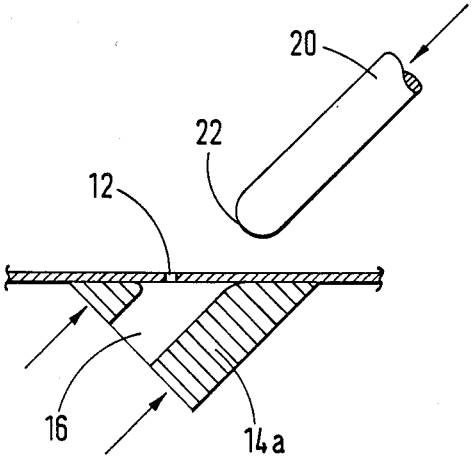
Figure 3B:
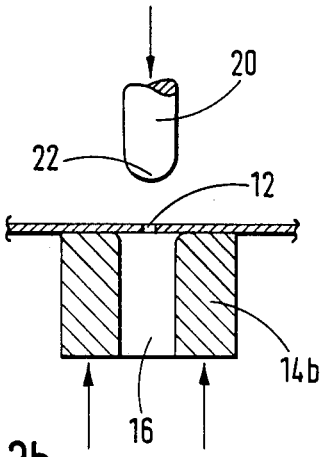

FIGS. 3*a* and 3*b* show the blank and the press or extrusion tool for formation of a angular brace stub and a straight brace stub, respectively.

Figure 4A:
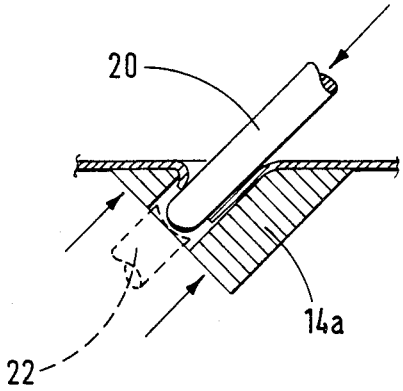

FIG. 4*a* is showing the tool, i.e. both the piston and the matrix, during the extrusion operation, during the finalizing phase of the formation of an angular brace stub.

Figure 4B:
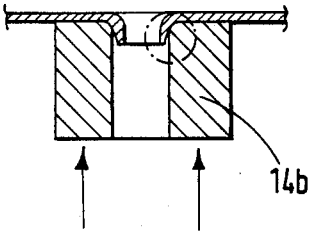

FIG. 4*b* shows the blank and matrix for straight brace studs.

Figure 4C:
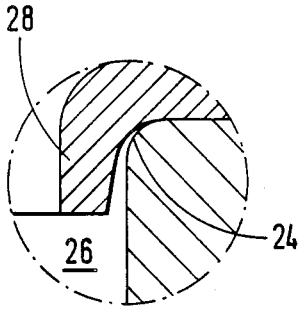

FIG. 4*c* is showing a fragmentary section shown in an enlarged scale.

Figure 5:
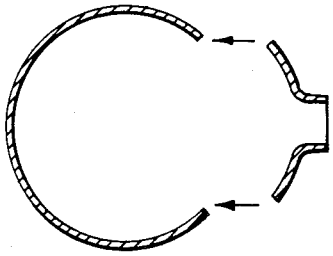

FIG. 5 is showing a schematic horizontal section of a leg which is being provided with a plate segment including the brace stub in accordance with the invention.

Figure 6A:
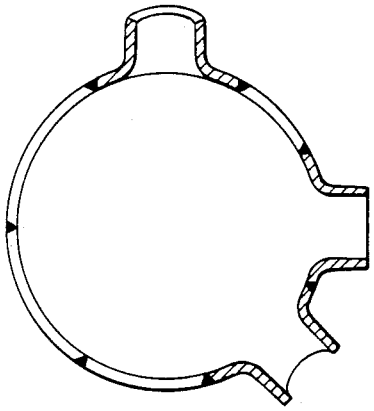

FIG. 6*a* is showing a schematic horizontal view through a leg with a node provided with brace stubs in accordance with the invention.

FIGS. 6*b*–6*e* are showing vertical fragmentary use of a node provided with brace stubs in accordance with the invention at various vertical elevational sections, figures b, c and d, the sections before assembly and Figure e showing the completed node.

Figure 6B:
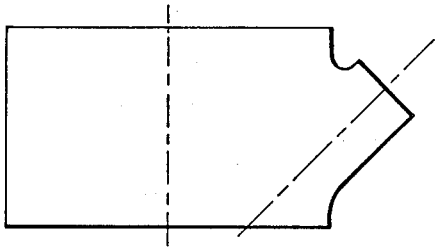
Figure 6C:
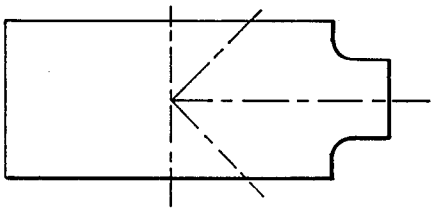
Figure 6D:
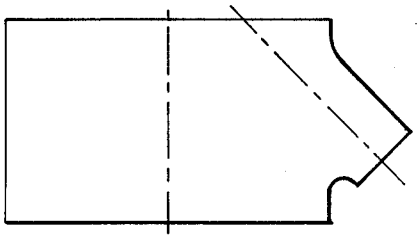
Figure 6E:
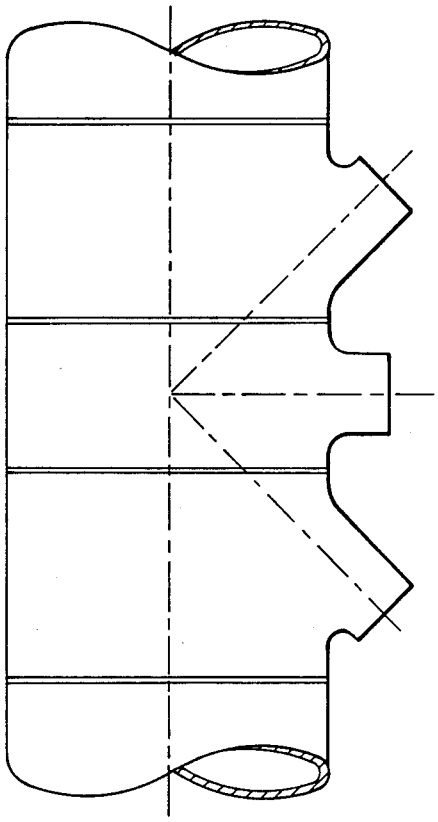
Figure 8:
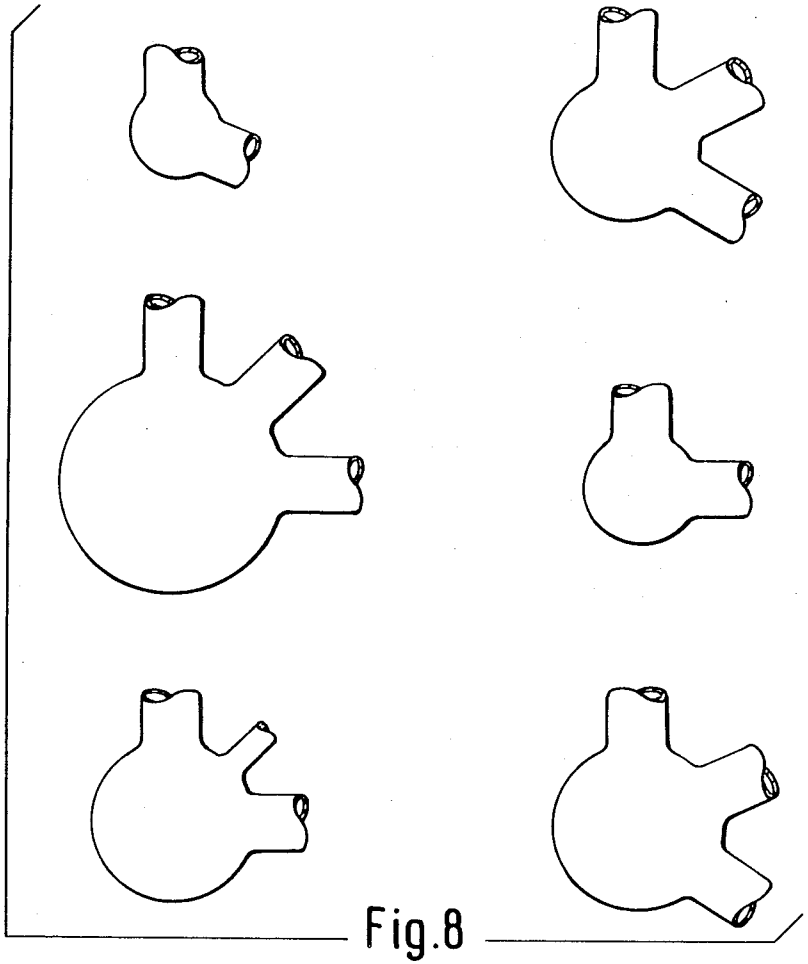
Figure 7:
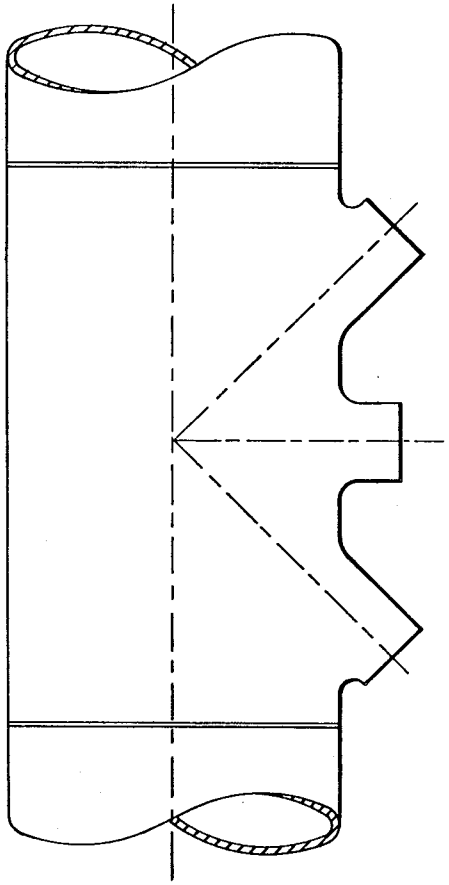

FIG. 7 is showing a node in accordance with the invention similar to the node shown in FIG. 6*e*, but wherein the plate segment or sections can be selected arbitrarily, FIG. 8 is showing altogether six versions of nodes in accordance with the invention.

A conventional node as shown in FIG. 1 is made by forming the mouth opening of an adjacent bracing and brace stub with a correct arched or curved opening edge the course of which will depend on the angle between the brace and the leg and the same as positioned directly in contact against the leg surface. The welding connection or weld fillet therebetween is in this design normally limited to a usual triangular or V-shaped weld fillet along the external opening or joint between the leg and the brace. In order to provide also an internal weld, the leg may initially be provided with a separate brace stub (frequently conical) which is welded on to the leg also with an internal weld which thereafter must be controlled, whereafter the brace is welded on to the brace stub with an annular weld, but then only with an external weld 7. With this design is created, particularly with angular bracing, a particularly critical zone as shown in a circle designated with the number 8 in FIG. 1*b*. In this area the access for welding will be rather poor and the subsequent control by means of ultra sound or x-ray equipment will be similarly difficult, if possible at all. This is rather unfortunate since just in this area the maximum or peak stresses will occur. Such peak stresses can frequently exceed 10 and up to 30 times the "normal stresses" in the node. The conventional solution with a weld in the node in this area will always imply a risk for fatigue failure in the transition zone between leg and bracing, particularly as a result of repeated compression and tension stresses. The operational life span of a such structure will be rather uncertain, particularly in connection with offshore platform rigs in areas exposed to heavy wave activities creating pulsing stresses of the beforementioned type.

FIGS. 3*a*, 3*b* and 4*a*, 4*b* and 4*c* illustrate the method for making a brace stub or transition piece to be used in a node in accordance with the invention. A ready curved or rolled plane section or plate of rolled steel as shown in FIG. 2 is provided with a starting bore 12. The plate blank is thereafter as shown in FIG. 3*a* or 3*b* positioned in a press- or extrusion tool having a matrix 14*a* (for angular brace stubs) or 14*b* (for straight brace stubs). The matrix is shaped with a die surface corresponding to the curvature of the plate blank (not shown) and is provided with an oval or circular opening 16, the dimensions of which correspond to the outside dimensions or diameter of the brace stub which shall be made. The opening or aperture in the matrix may in some cases with advantage be contoured with a somewhat reducing diametric dimension in direction outwards. When making an angular brace stub as shown in FIG. 3*a* the opening in the matrix is directed at an angle corresponding to the direction of the brace stub to be made, and the plate blank is positioned and fixed (not shown), such that the starting bore 12 is positioned somewhat disposed against the short side of the brace stub as shown. Thereby one can obtain that the blank goods under the extrusion deformation is travelling or moving such that the final brace stub attains a substantially circular, transverse end opening, and furthermore such that the goods gets a uniformly reducing thickness towards the end opening, but maintaining a substantially even thickness circumferentially, possibly with a somewhat larger thickness along the acute angular side in connection with angular brace stubs.

The press- or extrusion piston 20 as shown in FIGS. 3*a* and 3*b* and in FIG. 4*a*, is given a cylindric shape, possibly lightly conical in direction outwards, and the head or front end 22 is preferably given a spherical form alternatively slightly conical. The piston is supported in a regular press chuck or support, such that the piston can be moved axially towards the opening in the matrix. The piston should, however, also be arranged to undergo a certain lateral movement, since a lateral movement is desirable in the making of angular brace stubs whereby the starting bore is positioned somewhat laterally disposed relative to the stub axis, such as illustrated in FIG. 3*a*. In order to prevent initial fracture in the opening, the piston is initially positioned axially straight above the bore opening and is thereafter moved slowly towards the center axis corrolated with the gradual widening of the opening.

FIG. 4*c* shows the sectional fragmentary view in an enlarged scale of the encircled part shown in 4*b* and is illustrating the curvature 24 in the matrix opening 26, and a typical formation of a straight brace stub 28.

In the matrix opening may, if necessary, be positioned—in known fashion—a dolly or counter tool 23 as indicated with stitched lines 22 in FIG. 4*a*.

The press- or extrusion operation can take place in various fashions depending upon the product which shall be made and with or without preheating of the steel plate blank.

If the extrusion operation shall take place without heating, the extrusion operation must be interrupted several times, i.e. the extrusion must take place stepwise. The number of steps will depend upon the diameter of the brace stub and the thickness of the goods (usually the goods thickness will increase with the diameter of the brace stub and the brace). Between the extrusion steps one must carry out a heat treatment of the goods, such that the goods may pass through a re-crystallization and thereby regain its ductility for further deformation. One must continuously accurately control the extrusion operation in order not to exceed the yielding point of the goods.

The press- or extrusion operation can alternatively be carried out with a preheating, for instance in the temperature range 800°–1000° C.

The extrusion operation can then in some cases be carried out in one single relatively long-lasting or long-moving step, or alternatively in several steps, sometimes with a renewed heating, such that the goods can regain its ductility.

Through the above described press- or extrusion operations is obtained brace stubs in goods which will have a socalled oriented structure, such that a high strength material is obtained, simultaneously as one obtains an increased ductility in the extrusion direction. In a socalled cold pressing or forcing operation the blank will get rigid such that both the yield point, the fracture point and the hardness will be greater in the ready made brace stub than in the plate goods prior to the treatment.

Practical trials have shown that one may in this fashion produce brace stubs of very high quality, and the stubs can have rather large dimensions, for instance 1 to 2 meters and having goods thicknesses in the range up to 50–100 mm.

In making the tools it is obviously important that the opening edges in the matrix are given a suitable rounded off curvature, since this curvature will define the bending radius of the brace stub in the critical areas, i.e. the areas from the leg material proper to the stub proper.

Practical trials have shown that with a suitable design of the tool one can reach optimal results, i.e. a gradually decreasing goods thicknesses in the stub from the thickness in the leg or wall thickness in the transition piece which shall form a segment of the leg to the wall thickness in the adjacent bracing which usually shall have a far smaller thickness (usually 20–50% of the wall thickness in the leg). Practical trials have furthermore shown that one can reach the desired result that the thickness at the leg wall side is maintained along the critical bending zone where the need for goods thicknesses is important. It will be understood that through the invention one can entirely avoid welding joints in the areas or sections of the node where the critical or peak stresses will concentrate. In addition one will in these areas have a homogeneous and in most cases stronger material than in the leg or the bracing proper.

In regard the length of the brace stub, this will for a stub extending in 45° angle be of size substantially corresponding to the radius of the brace, and not in any case below a length such that the goods at the acute angle side of the stub extends parallel or substantially parallel with the center axis of the brace, such that one obtains a flush alignment along the transition to the bracing and preferably having a circular opening edge. In connection with straight stubs the length is not particularly critical, but the stub ought to be at least so long that the stub walls extend substantially parallel with the center axis, and further at least so long that the goods thickness along the opening edge substantially corresponds to the goods thicknesses of the adjacent bracing. One may, however, if desired, weld on to the stub a preferably conical transition piece which can be given decreasing goods thicknesses towards the outer end or mouth for welding to the bracing.

To mention something about the actual strength of a node in accordance with the invention, one can inform that the fatigue strength durability for a node in accordance with the invention has through trials been measured up to 10 times the lifetime of a conventional welded node of same type and same dimensions.

Alternatively one may on this basis find it permissible to increase correspondingly the allowable fatigue stresses and maintain the same lifetime as for a corresponding conventional welded node.

In some practical cases it may in connection with angular stubs, particularly if the angle exceeds 45°, prove difficult to obtain sufficient demands of goods in direction outwards on the longer side of the stub wall such that one can obtain the desired transfers end opening on the stub relative to the longitudinal axis of the stub with conservation of an even goods thickness around the circumference of the stub. In order to maintain an even goods thickness, particularly at the opening edge of the stub, something which is rather important, it may be necessary or desirable to make a stub which is shortened or sloped against the longer side of the stub wall. The mouth of the stub will then be positioned in a plane which is not located transversely relative to the longitudinal axis of the stub, and the mouth opening of the stub will attain an oval or elliptic shape. Such shape will demand a mating elliptic shape on the mouth opening of the adjacent bracing which shall be welded to the brace stub and complicates somewhat the joining operation between the node and the bracing.

As previously mentioned, FIG. 6*a* shows a schematic sectional plan view through a node in accordance with the invention.

FIGS. 6*b*, *c* and *d* are showing three sections of a node in accordance with the invention before assembly, and FIG. 6*e* is showing the sections illustrated in Figures b, c and d in assembled position, comprising altogether three brace stubs, each located in a separate vertical space part of the leg. The leg portions of the node are such designed that the center axes of all brace stubs coincide at the vertical center axis of the leg thereby obtaining a statically stable design.

FIG. 7 is showing a node structure similar to the one shown in FIG. 6*e*, but without defining any special separation lines in the leg structure forming the node indicated that the plate segments including the brace stubs can be selected arbitrarily in accordance with specific demands.

The above described and shown examples are only shown with the aim to illustrate the method in accordance with the invention. The scope of the invention is defined by the attached patent claims.

We claim:

1. Method for providing transition member between structural elements for a node in a frame work truss structure, particularly for offshore platforms such as drilling and production platforms, said method comprising:

(a) providing a blank of rolled steel plate of curved shape with suitable size and thickness for constituting a section of one of the structural elements, (b) positioning the blank in a two-part pressing and extrusion tool composed of a matrix curved to match the curved shape of the blank and provided with a matrix opening with a rounded transition surface leading into the matrix opening and corresponding to the desired outside surface of a brace stub to be formed in the blank and, a piston-like pressing tool with a diameter substantially corresponding to the desired inside diameter of the brace stub to be formed and having a rounded off working end, said piston being arranged to be movable towards and into said matrix opening in the matrix, and (c) forming a brace stub terminating with a brace stub opening from the part of the blank covering the matrix opening by moving the piston towards the matrix with the blank positioned thereon effective to press the part of the blank covering the matrix opening into the matrix opening about the rounded transition surface causing an extrusion deformation of the part of the blank covering the matrix opening to extend the length of the brace stub and to form in the blank the brace stub having inside and outside surfaces smoothly curved from the blank proper towards the brace stub opening with gradually decreasing wall thickness from the blank proper to the brace stub opening as a result of the extrusion deformation.

2. Method in accordance with claim 1, wherein the blank is provided with an initial aperture.

3. Method in accordance with claim 1, including the further step of forming an initial aperture in the part of the blank covering the matrix opening.

4. Method in accordance with claim 3, wherein the initial aperture is positioned laterally disposed relative the matrix axis.

5. Method in accordance with claim 3, wherein the initial aperture is aligned with the matrix axis.

6. Method in accordance with claim 1, including the further step of preheating the blank.

7. Method in accordance with claim 6, wherein the preheating is from about 800° C. to about 1000° C.

8. Method in accordance with claim 1, wherein the piston is moved toward the matrix in a series of repeated steps.

9. Method in accordance with claim 8, wherein the blank is heated between successive steps.

10. Method in accordance with claim 1, wherein the brace stub is formed obliquely to the blank proper.

11. Method in accordance with claim 1, wherein the brace stub is formed normal to the blank proper.

12. Method in accordance with claim 1, wherein two brace stubs are formed from the blank.

13. Method in accordance with claim 12, wherein the central axes of the two stubs have different angular orientations with respect to the blank proper.

* * * * *